US008125133B2

(12) United States Patent
Heidbüchel et al.

(10) Patent No.: US 8,125,133 B2
(45) Date of Patent: Feb. 28, 2012

(54) LAMP COMPRISING A BASE THAT IS MOUNTED WITHOUT CEMENT

(75) Inventors: Hans Heidbüchel, Remscheid (DE); Herbert Roderwieser, Lindlar (DE); Thomas Schröder, Wipperfuerth (DE)

(73) Assignee: Osram AG, Munich (DE)

( * ) Notice: Subject to any disclaimer, the term of this patent is extended or adjusted under 35 U.S.C. 154(b) by 880 days.

(21) Appl. No.: 11/659,039

(22) PCT Filed: Jul. 15, 2005

(86) PCT No.: PCT/DE2005/001253

§ 371 (c)(1), (2), (4) Date: May 31, 2007

(87) PCT Pub. No.: WO2006/012834

PCT Pub. Date: Feb. 9, 2006

(65) Prior Publication Data

US 2007/0267956 A1 Nov. 22, 2007

(30) Foreign Application Priority Data

Aug. 2, 2004 (DE) ..... 10 2004 037 381

(51) Int. Cl.
*H01J 5/48* (2006.01)

(52) U.S. Cl. ..... 313/318.01; 313/318.05; 313/318.09; 313/318.1

(58) Field of Classification Search ..... 313/318.01, 313/318.05, 318.09, 318.1; 362/89
See application file for complete search history.

(56) References Cited

U.S. PATENT DOCUMENTS

| | | | | |
|---|---|---|---|---|
| 1,797,031 | A | 3/1931 | Van Horn et al. | |
| 2,032,232 | A | 2/1936 | Strickland | |
| 2,104,784 | A * | 1/1938 | Wiegand et al. | 174/50.53 |
| 2,873,510 | A | 2/1959 | Duran et al. | |
| 3,447,016 | A * | 5/1969 | Rycroft | 313/317 |
| 4,570,104 | A * | 2/1986 | Janssen et al. | 315/50 |
| 4,743,481 | A | 5/1988 | Quinlan et al. | |
| 5,541,249 | A | 7/1996 | Hughes et al. | |
| 5,757,125 | A * | 5/1998 | Furlong et al. | 313/503 |
| 6,469,428 | B1 * | 10/2002 | Thiel et al. | 313/318.09 |
| 6,528,145 | B1 | 3/2003 | Berger et al. | |
| 2005/0286243 | A1 * | 12/2005 | Ranish et al. | 362/89 |

FOREIGN PATENT DOCUMENTS

| | | |
|---|---|---|
| CA | 1 192 942 | 9/1982 |
| CN | 1330403 A | 1/2002 |
| DE | 10 52 580 | 3/1959 |
| DE | 18 97 482 | 7/1964 |
| DE | 41 20 833 | 1/1993 |
| DE | 195 12 407 | 10/1996 |
| DE | 102 20 735 | 5/2002 |

(Continued)

OTHER PUBLICATIONS

Kroke E et al: "Silazane derived ceramics and related materials" Materials Science and Engineering R: Reports, Elsevier Sequoia S.A. Lausanne, CH, Bd. 26, Nr. 4-6, Apr. 2000.

Baldus H -P et al: "Novel high-performance ceramics-amorphous inorganic networks from molecular precursors" Angewandte Chemie (International Edition in English) VCH Verlagsgesellschaft Germay, Bd. 36, Nr. 4, Mar. 3, 1997, pp. 328-343.

(Continued)

*Primary Examiner* — Nimeshkumar Patel
*Assistant Examiner* — Mary Ellen Bowman

(57) ABSTRACT

The invention relates to a light bulb (1), the end of which is provided with a polymer ceramic base (5). Said base (5) is injection molded directly onto the end of the bulb.

13 Claims, 8 Drawing Sheets

FOREIGN PATENT DOCUMENTS

| | | | |
|---|---|---|---|
| EP | 652 610 | | 11/1993 |
| EP | 0639849 | A1 | 2/1995 |
| EP | 897 604 | | 3/1997 |
| EP | 1 009 013 | | 12/1998 |
| EP | 0 975 000 | | 11/2000 |
| EP | 1 139 388 | | 10/2001 |
| GB | 443 713 | | 3/1936 |

OTHER PUBLICATIONS

The Chinese Office Action dated Jul. 30, 2010 (English/German translation thereof).

* cited by examiner

LAMP COMPRISING A BASE THAT IS MOUNTED WITHOUT CEMENT

TECHNICAL FIELD

The invention is based on a lamp, in particular a high-pressure discharge lamp or incandescent lamp, in accordance with the precharacterizing clause of claim 1. Of particular relevance here are metal-halide lamps, high-pressure sodium lamps or halogen incandescent lamps having a pinch seal at one end and a ceramic base, but also conventional incandescent lamps.

PRIOR ART

EP-A 1 009 013 and the prior art cited therein have disclosed a lamp in which the base consists of a conventional ceramic material. Such a base needs to be connected to the bulb either by means of cement or by means of a separate element producing the connection, such as a metal spring, for example. In addition, the poor workability of the conventional ceramic materials results in complex fixing and insertion of electrical parts of the base. In particular, fixing of the contact elements and possible installation of a fuse can only be implemented very laboriously. In addition, in the case of the use of base cement, the amount of time consumed is very considerable owing to the baking that is required.

DESCRIPTION OF THE INVENTION

The object of the present invention is to provide a lamp in accordance with the precharacterizing clause of claim 1 which can be produced easily and rapidly and nevertheless withstands high loads.

This object is achieved by the characterizing features of claim 1. Particularly advantageous configurations are given in the dependent claims.

In principle, the lamp according to the invention has an enveloping part, in particular a bulb, usually consisting of glass. This bulb is often the outer bulb of a discharge lamp or a halogen incandescent lamp which has been manufactured from quartz glass or hard glass. The term enveloping part should be understood here expressly also in the broader sense, for example in the sense of a reflector dome of a reflector lamp. Often, the bulb is the only bulb of a discharge lamp or incandescent lamp. The enveloping part generally has one or two ends. It can be used in particular for sealing a bulb. However, this function is not relevant in the context according to the invention. It is essential that the end acts as an anchor part for fixing the base. Accordingly, one or two power supply lines are passed to the outside through the enveloping part at the end. According to the invention, the base is manufactured from polymer-ceramic. The term polymer-ceramic means a ceramic from material which is also referred to as a polymer-ceramic composite material or polymer matrix composite material or polymer-ceramic composite.

In general, at least one outer contact pin is fixed to the base, which contact pin produces the electrical connection between a power supply line of the lamp and the voltage source, which is supplied via a lampholder. For this purpose, the contact pin is connected to the associated power supply line. In principle, the base can be produced in advance from polymer-ceramic as a component. However, particularly preferably the lamp, including the contact pins already connected to the power supply lines, is prefabricated apart from the base and only then is the base material applied to the contact pins as an injection-molding compound, the compound being injection-molded around the pins.

The procedure is similar for a fuse section which may be introduced into the base. This fuse section can also be fitted on the lamp, which is finished apart from the base, as a fuse component and then subsequently injection-molded with base material.

Accordingly, it is particularly advantageous if the base is injection-molded directly to the end of the bulb, in particular it also being possible for the contact pins and any fuse to be injection-molded in one step.

The material of the base is generally a polymer-ceramic, in particular a composite material. In this case, the composite material may be inorganic, organic or a mixture of organic and inorganic components.

Such materials are known per se, for example from the literature such as the textbook Werkstoffe [Materials], Springerverlag, ISBN 3540573259. Known materials are, for example, carbide and nitride materials of inorganic polymers. The thermal stability of silicon carbonitride ceramics is very high.

The method for producing a lamp is based on the current principles of processing polymer-derived ceramics. One decisive advantage is their potentially simple processing in terms of plastics technology to form complex molded parts by means of extruding or injection-molding polymeric compounds and by cold-processing polymeric molded parts. Subsequent thermolysis gives the ceramic component. The volume shrinkage associated with the conversion of the polymer to the ceramic can be set in a targeted manner by adding active or inactive fillers. Special mention should be made of the excellent stability at high temperatures of amorphous Si(B)CN compositions. They are characterized by a high resistance to oxidation and a high creep resistance; crystallization takes place only above from 1400° C. to 1600° C. The polymer-ceramic transformation plays a decisive role in the above-mentioned method for producing new ceramic materials. Furthermore, the thermal stability of the carbonitrides produced is advantageous in terms of decomposition and corrosion.

Accordingly, the base can be fused in directly with the fuse and the contact pins as a finished base. Terminal plates as spring elements, as are used in the prior art in which standard ceramic such as steatite is used, are no longer absolutely necessary. The disadvantage of standard ceramic is, in particular, the fact that no component can be embedded in it. On the other hand, both a holding means and a fuse etc. can be embedded in polymer-ceramic similarly to in the case of normal plastic. In addition, the tolerance of a base consisting of standard ceramic is very high. It is approximately 15%. On the other hand, the tolerance of the polymer-ceramic base according to the invention is considerably lower. It is below 1%.

The manufacture can therefore be considerably simplified. Until now, a frame needed to be prefabricated, and then the frame needed to be equipped with and connected to a tubular bulb such that power supply lines protruded outwards from the bulb. Then, connecting wires needed to be attached to the power supply lines and any desired fuse fitted. At the same time as this, the contact pin(s) needed to be inserted into the base and anchored there, and then the bulb needed to be inserted into the base and the lamp-side feed lines needed to be connected to the contact pins, which was very time-consuming. Possibly, a cement then needed to be filled into the base or, prior to this, a spring element also needed to be introduced into the base. Overall, this sequence is very cost-intensive and susceptible to errors. Until now the rejects have been considerable.

In contrast, a ready-equipped base can now be produced in advance by the material of the base being injection-molded directly around the contact pin, or a plurality of contact pins, and then possibly a fuse being inserted. Insulating material for the fuse can be dispensed with here. Particularly advantageous is the circumstance that, owing to the generally high insulating property of such materials, shorter fuse sections are possible. Such bases may therefore have a more compact design than conventional bases.

In one particularly preferred embodiment, the base is injection-molded directly to the bulb or the reflector envelope. In this case, the material of the base needs to be matched carefully to the material of the enveloping part, for example in terms of adhesiveness and the coefficient of thermal expansion. In this embodiment, an additional component such as, for example, a spring element or base cement, is not required. The bulb and the base are automatically always centered with respect to one another owing to the production. The lamp is finished immediately after the injection molding, and the number of manufacturing steps is markedly reduced. The heat dissipation during operation of the lamp is also improved in comparison with conventional ceramic. The atomization is simplified in every respect.

Particularly preferably, the contact pins are also manufactured from the same or a similar material as the rest of the base, it being possible for these pins to be integrally formed on the rest of the base body. These pins are preferably hollow and can subsequently be metallized on the inside and/or outside. A suitable method is by means of electroplating or vapor deposition.

The base can be produced in particular in a multicomponent injection-molding process, a material which is resistant to high temperatures being used for parts which are subjected to a high load in the immediate vicinity of the enveloping part (in particular if this is the only bulb), and another material being used for parts which are subjected to a less severe thermal load. One very specific configuration is as follows: the contact contour can alternatively be produced together with the rest of the base body in a multicomponent injection-molding process, it being possible for the contact pin contour to be produced from conductive compound material, for example a conductive cermet, or else polyphenyl compound or carbon fiber material.

The base preferably contains an integrated fuse section. This means one or else several additional contact elements which are each connected to one of the contact pins via fuse wires.

The method consists essentially in the fact that, first, the contact pins are produced, and then the precursor material, as explained above, of the polymer-ceramic material is injection-molded around the contact pins. This basic principle can, on the other hand, be used for manufacturing a separate base. In this case, the previously manufactured, ready-equipped base is connected to the bulb by means of a holding element, preferably a spring element, or else cement.

An alternative method consists in the fact that the base is produced with an integrated fuse section, and then the region of the fuse section or else any region with integrally formed contact pins, is subsequently metallized.

An alternative method consists in the fact that, first, a first basic base body is manufactured from a material which is resistant to high temperatures, and then an additional part consisting of a material which is less resistant to high temperatures is attached.

On the one hand, thermoplastic injection-molding compound can generally be used in the production process. Typical examples of this class of materials are PEEK (polyether ether ketone), PPS (polyphenyl sulfide) or PPO (polyphenyl oxide). Polyamide can also be used. Another technique is the use of thermo-setting transfer-molding compounds of organic or inorganic compositions. A typical example is Bakelite. In particular phenol resins or epoxy resins are used here.

Instead of or in addition to the integrated contact pins or fuse sections, additional holding and spring elements consisting of spring steel or other metallic or nonmetallic materials can of course be introduced or pressed into the base. When the enveloping part is fitted, these elements may result in graded latching in the fitting direction and act as a manner of safeguarding against a movement in the opposite direction in a form-fitting and force-fitting manner. Owing to this manner in which they are introduced, in particular plugged in, sanding and/or cementing is dispensed with. The fitting possibilities are extended by clamping receptacles in the inner contact pin region such that a thermally induced connection between the power supply line and the contact pin can be dispensed with.

In one preferred embodiment, the contact pins have already previously been connected to the bulb by them being welded to the outer power supply line, for example. Only then is the base injection-molded around the contact pins. In this case, the base is preferably also injection-molded around the end or one end of the enveloping part.

In one further embodiment, the base is produced only partially from polymer-ceramic, to be precise to the extent that this material is used for the base insulator known per se. This base insulator can now adhere directly to the bulb owing to the injection molding.

Particularly preferred is an exemplary embodiment of a reflector lamp in which not only the base but also the dome of the reflector is manufactured from the polymer-ceramic material.

One further aspect of the invention relates to the application of the polymer-ceramic material to a lampholder for electric lamps.

FIGURES

The invention will be explained in more detail below with reference to a plurality of exemplary embodiments. In the drawing:

FIG. 1 shows a side view of a metal-halide lamp;

FIG. 2 shows the metal-halide lamp prior to the base being fitted;

FIG. 3 shows one exemplary embodiment of an equipped base;

FIG. 4 shows a side view, partially sectioned, of a halogen incandescent lamp with the equipped base shown in FIG. 3;

FIGS. 5 and 6 each show a side view, partially sectioned, of one exemplary embodiment of a halogen incandescent lamp;

FIGS. 7 and 8 each show a side view, partially sectioned, of a further exemplary embodiment of a base;

FIG. 9 shows a further exemplary embodiment of a halogen incandescent lamp;

FIG. 10 shows a further exemplary embodiment of a halogen incandescent lamp having a lampholder.

The protection against electric shock is ensured in an ideal and very simple manner by the base 5 directly surrounding the pinch seal of the bulb 1, which until now has not been possible since the bulb until now has necessarily been manufactured separately and therefore in any case has needed to have an opening for accommodating the bulb. In that case, a safety distance needed to be maintained which is not required now, with the result that the lamp can have a more compact design.

Figure 1:
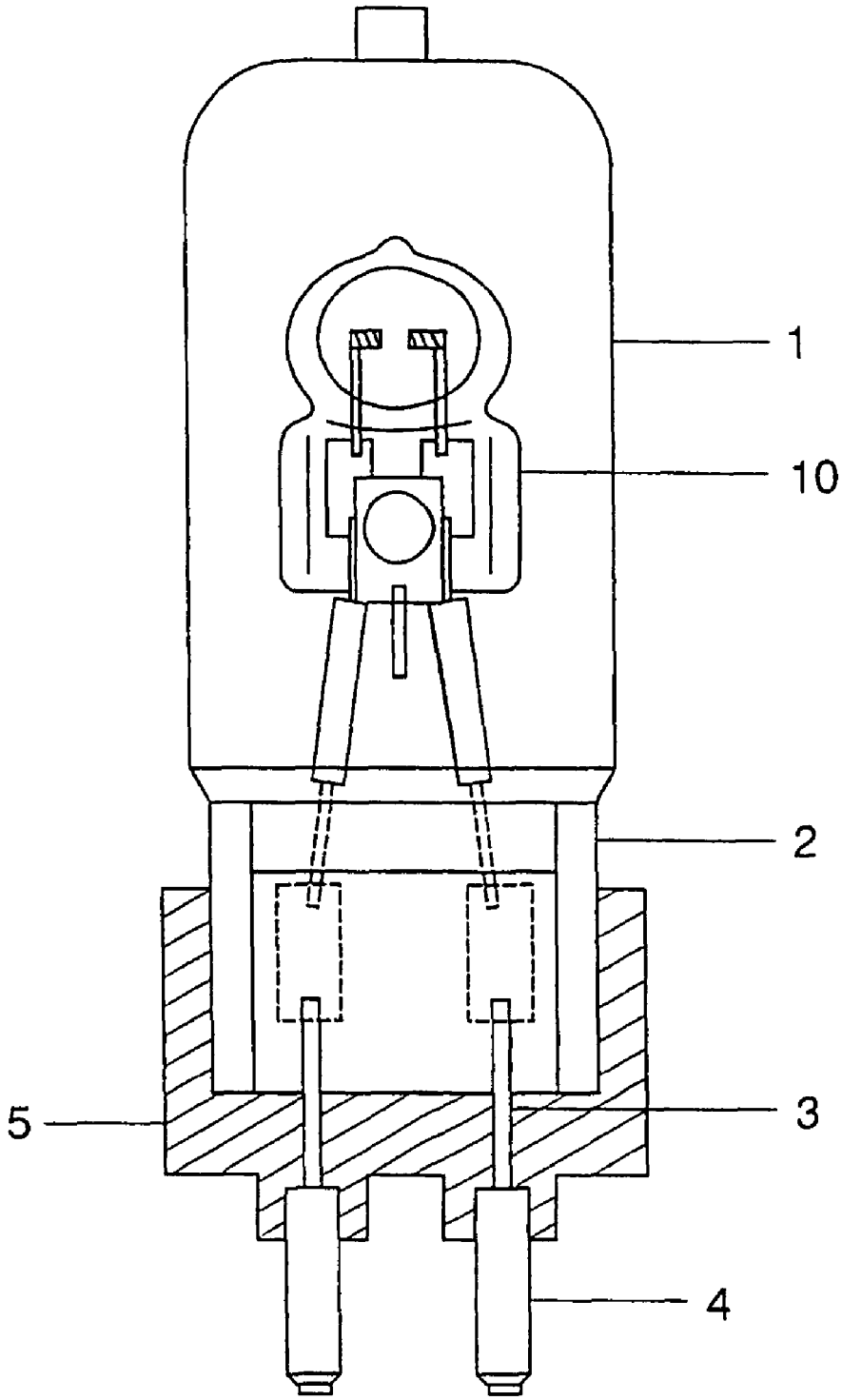
FIG. 1 shows a metal-halide lamp having an outer bulb 1 consisting of hard glass (or quartz glass), which has a longitudinal axis and is closed at one end by a pinch seal 2. Two power supply lines 3 are passed to the outside at the pinch seal 2, which is typically in the form of a double T or else in the form of an I. They end in outer contact pins 4, which are inserted into a base 5 consisting of polymer-ceramic. A discharge vessel 10 consisting of quartz glass or else ceramic having a filling consisting of metal halides is inserted in the outer bulb. The base 5 is fixed to the pinch seal 2 in the same manner as to the contact pins 4 directly by means of injection molding. The vessel held by the base can also be manufactured from ceramic.
Figure 2:
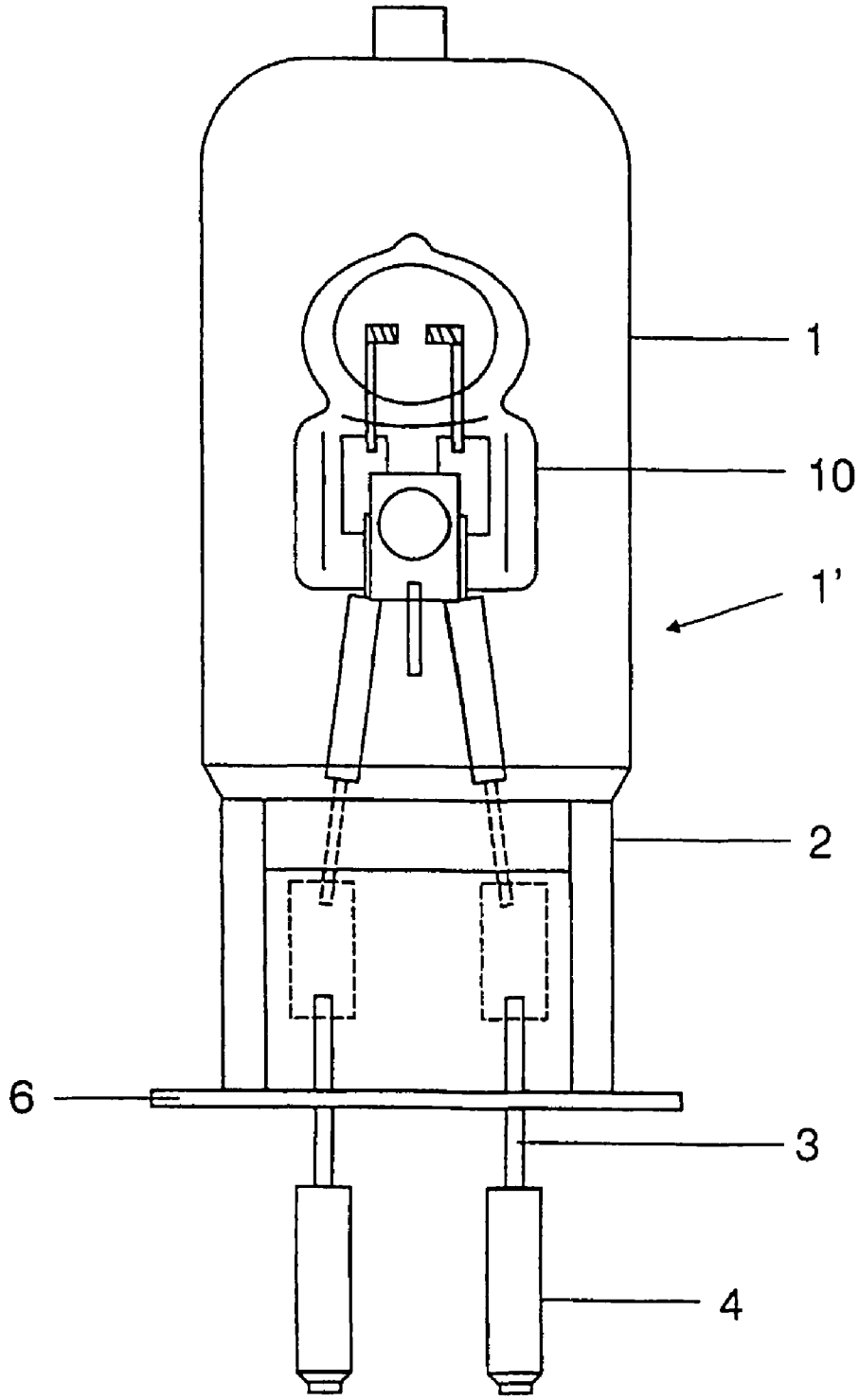

For the production, in particular a structural unit 1' is first prepared from the lamp, which is finished per se, without the base as shown in FIG. 2, the power supply lines 3 of said structural unit 1' already being connected to the contact pins 4 in contrast to the conventional technique. This takes place, for example, by means of crimping or welding. For the connection to the base, the lamp is provided with a provisional holder 6. This holder then acts as an adjusting aid and stop for the injection-molding die, into which the precursor material of the base is filled.

Figure 3:
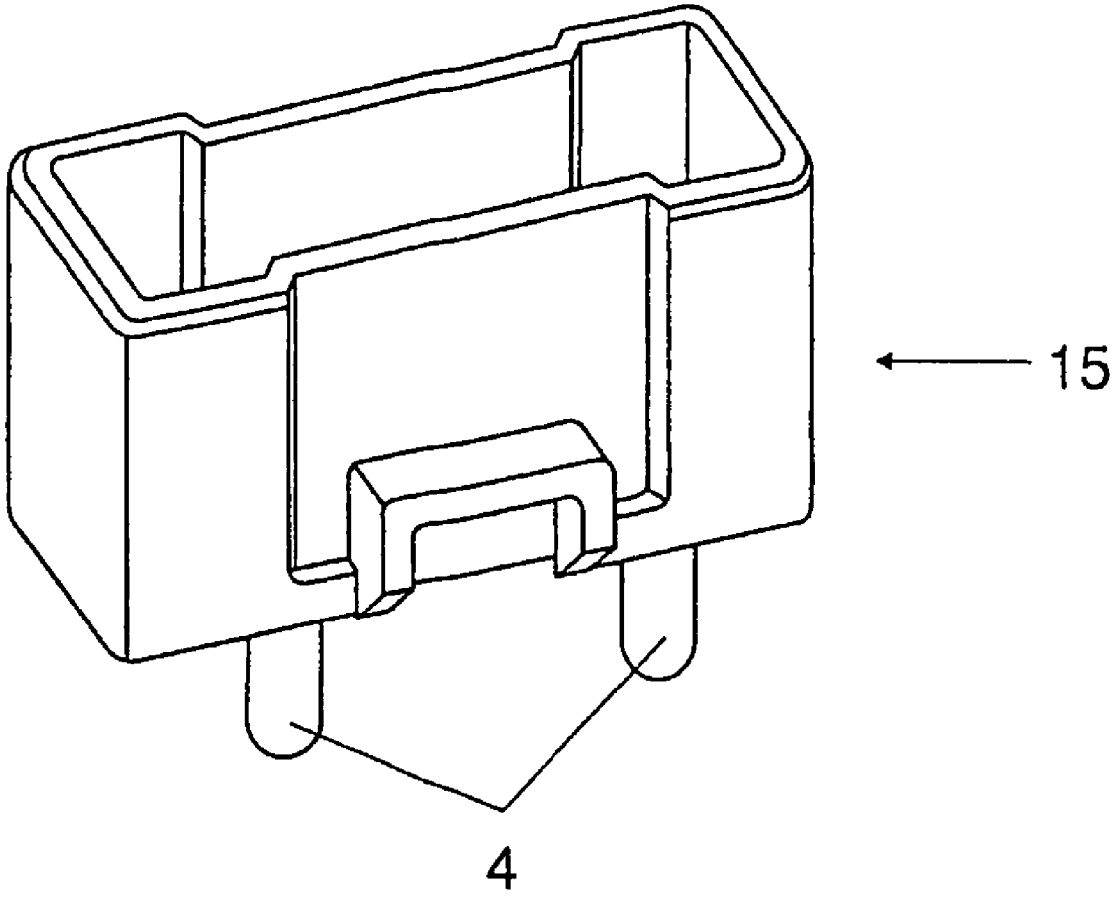
Figure 4:
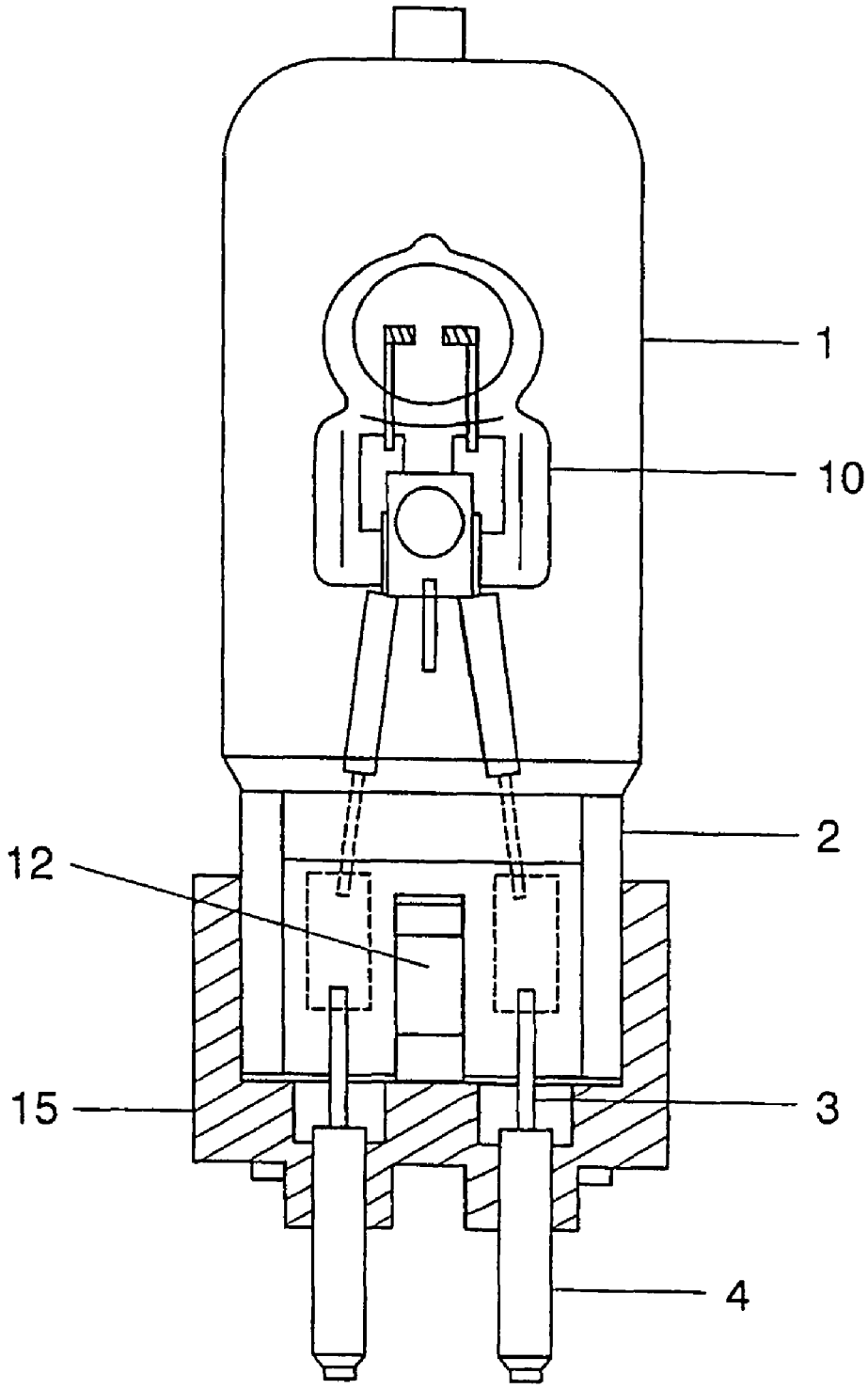

FIG. 3 shows a separately manufactured base 15, which only surrounds the contact pins 4. This base is also produced by injection molding, but only with the contact pins 4 as the components to be injection-molded. Then, as shown in FIG. 4, the outer bulb 1 of the lamp is conventionally fixed to the ready-manufactured base 15 by means of a resilient holding element 12, in a similar manner to as in EP-A 1 009 013.

Figure 5:
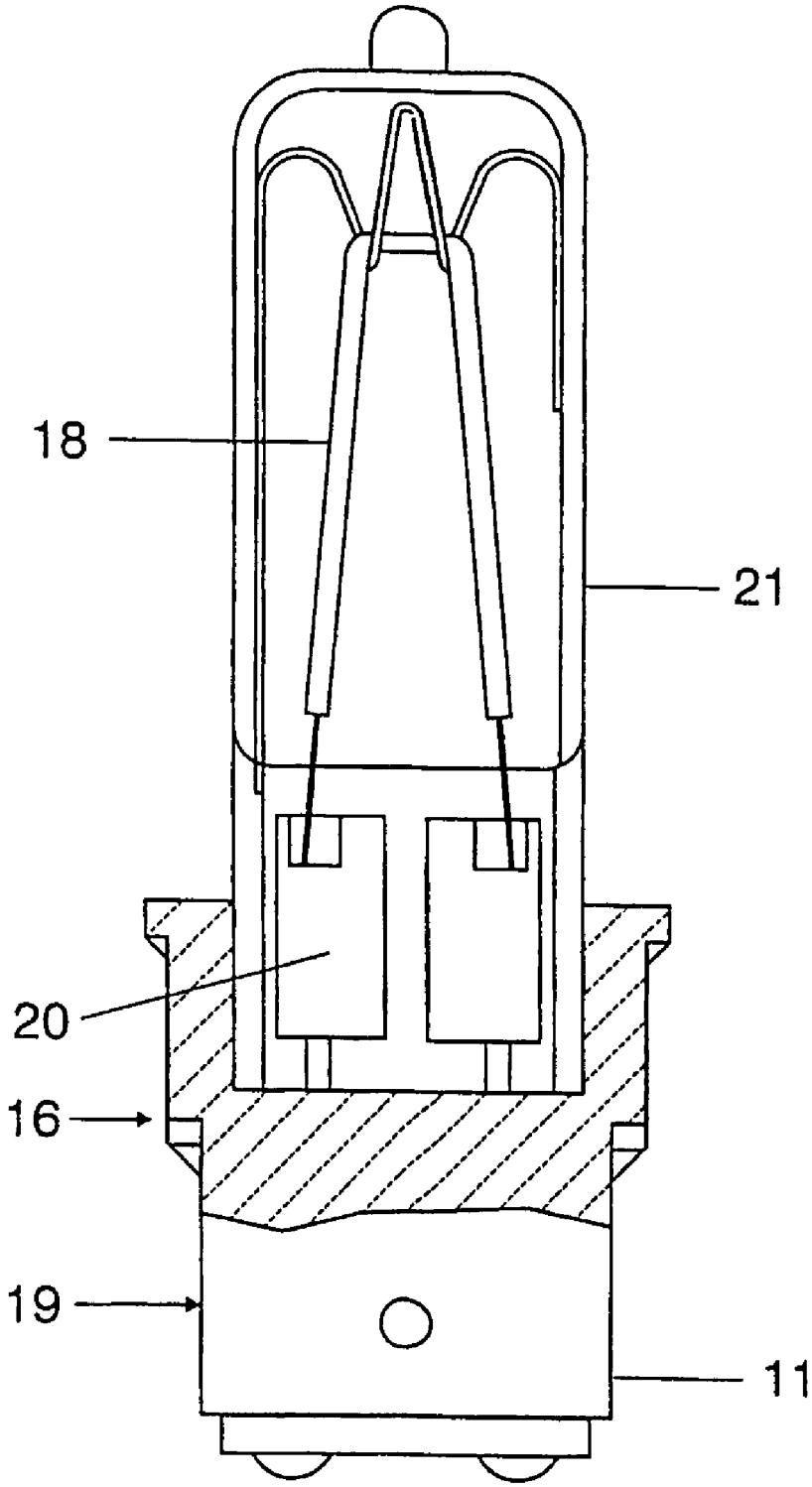

FIG. 5 shows a halogen incandescent lamp 18 having a base 19, in which only the base insulator 16 is produced from polymer-ceramic. The base insulator surrounds the pinch seal 2, which acts as the end of the bulb 21. The base 19 is produced by a metal cap 11 known per se being anchored on the base insulator 16 such that a conventional bayonet-type base is produced. In a similar manner, a screw-type base can also be realized.

Figure 6:
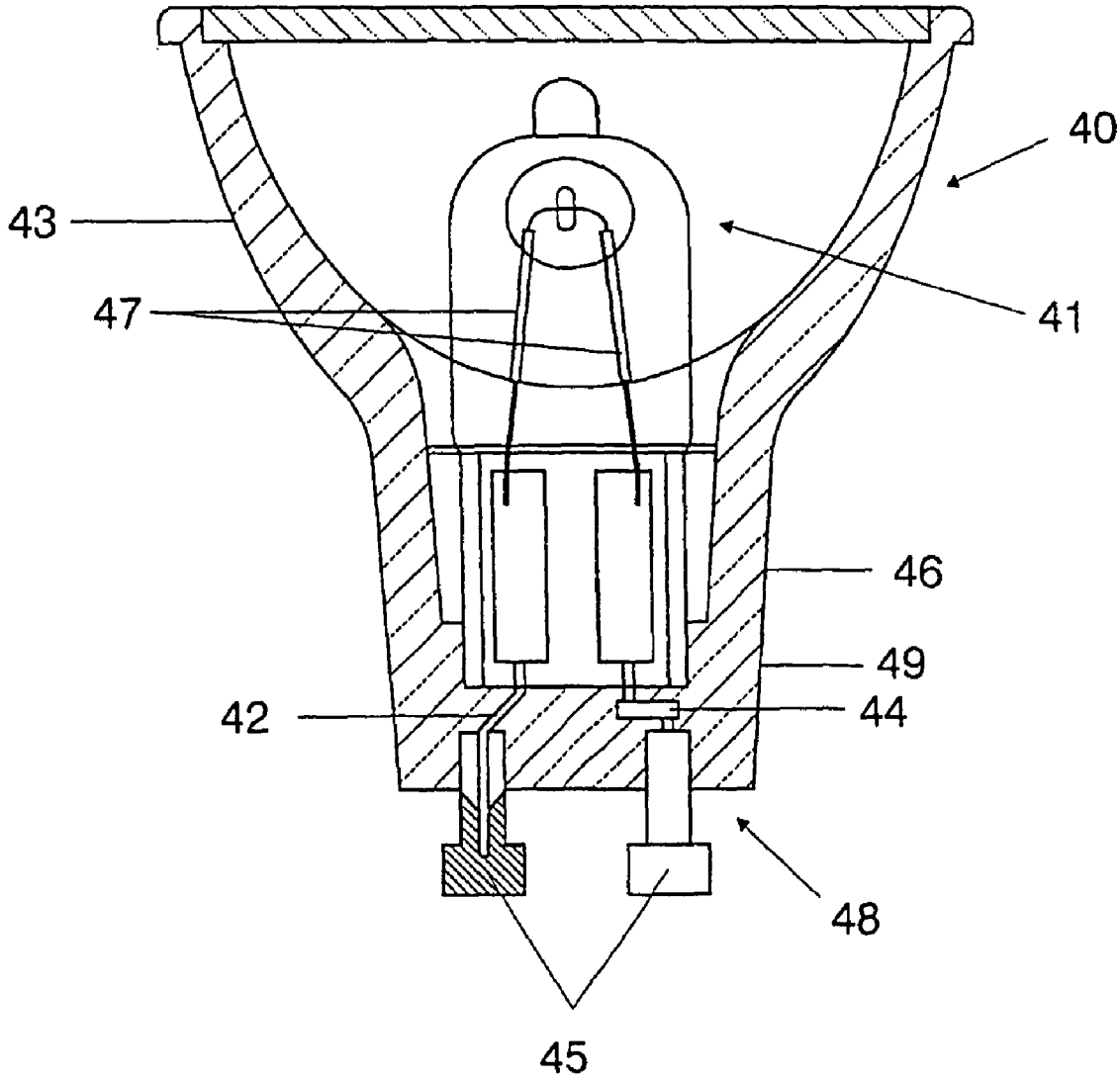

FIG. 6 shows an exemplary embodiment of a reflector lamp 40, in which not only the base 48 but even the reflector 43, which is integrally attached to the base, consist of polymer-ceramic. The contact pins 45 with part of the pinch seal 46 are surrounded directly by the material of the base. A bulb 41, which surrounds the luminous body 47, is accommodated in the neck 46 of the reflector. The power supply lines 42 end in the contact pins 45. One of these power supply lines is equipped with a conventional fuse 44, which is surrounded by the material of the base 48.

Figure 7:
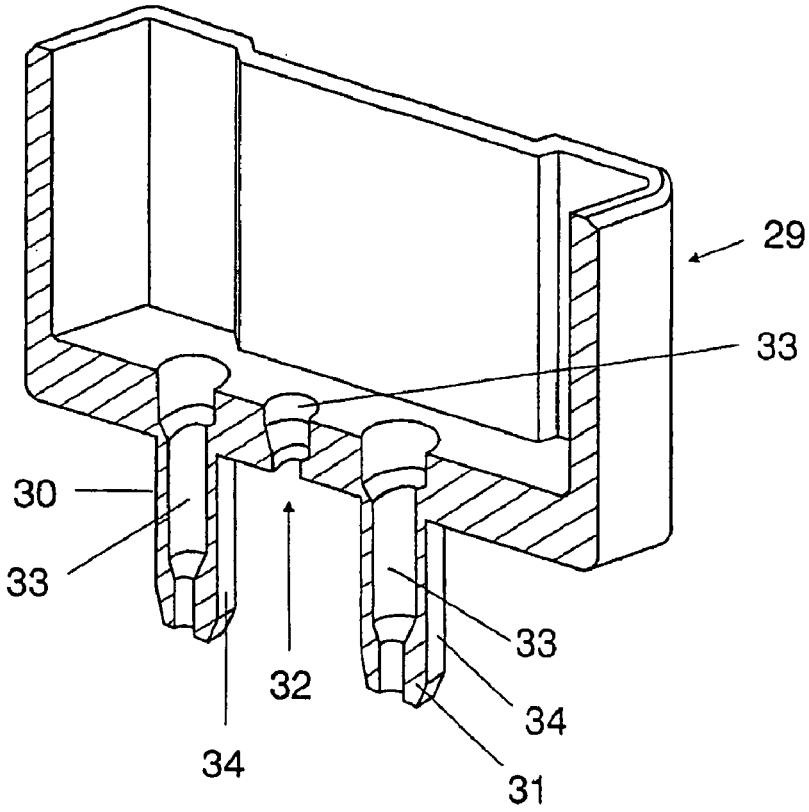

FIG. 7 shows a base 29, which is equipped with integrally formed hollow contact pins 30, 31 as the contour. Furthermore, it has a fuse section 32, which is arranged centrally between the contact pins as a funnel. The base 29 consists completely of a uniform polymer-ceramic material. In the region of the contact pins 30, 31 and the fuse section 32, however, a metallic coating 33 is subsequently applied on the inside. In the region of the contact pins 30, 31, a coating 34 is also applied on the outside, in addition.

Figure 8:
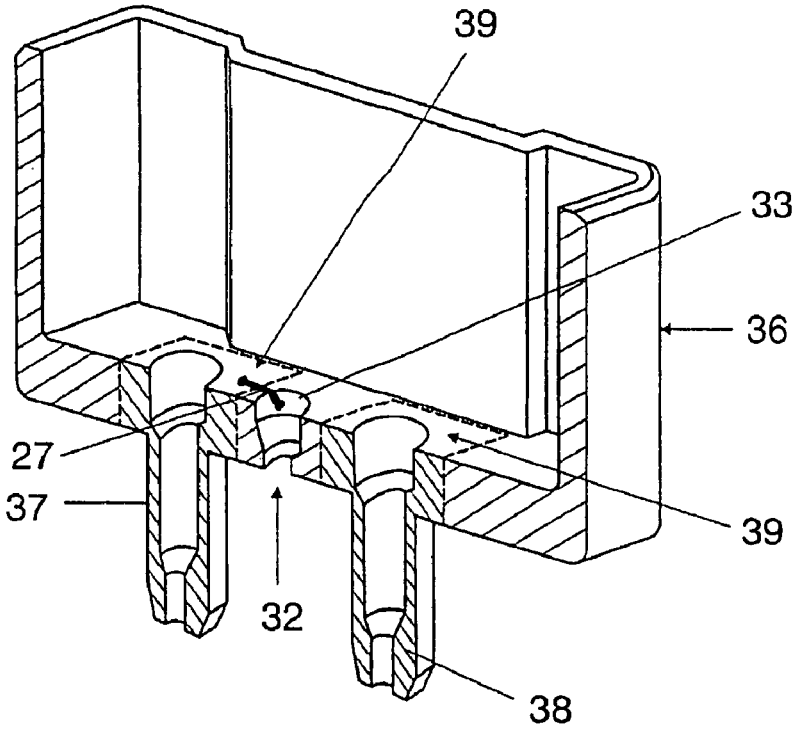

FIG. 8 shows a base 36, which is equipped with attached contact pins 37, 38 as the contour. Furthermore, it has a fuse section 32, as in FIG. 7, which is arranged centrally between the contact pins as a funnel. The base 36, apart from in each case one strip-shaped region 39 which contains the contact pins, consists completely of a uniform nonconductive polymer-ceramic material which is resistant to high temperatures. In the strip-shaped region 39 which contains the contact pins, however, an electrically conductive cermet is used such that a metallic coating can be dispensed with there. Such cermets are described in principle, for example, in CA-A 1 192 942. Alternatively, the strip 39 consists of a polyphenyl compound or carbon fiber materials having a low content of metal. The fuse section 32 furthermore has a coating 33. This fuse section is on the one hand connected to a contact pin via a fuse wire 27 and, on the other hand, one of the power supply lines (not shown) ends there. This wiring is similar to that used for the separate fuse shown in FIG. 6.

Figure 9:
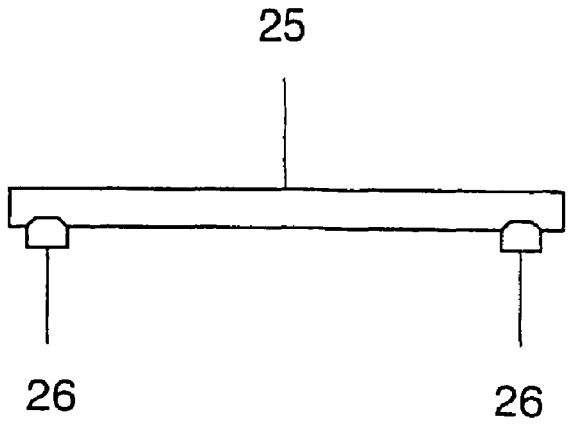

FIG. 9 shows a halogen incandescent lamp 25 in the form of a tubular lamp. The base contacts 26 known per se are now manufactured from conductive polymer-ceramic and injection-molded directly to the bulb, in which case they encase power supply lines which pass out of the bulb.

Figure 10:
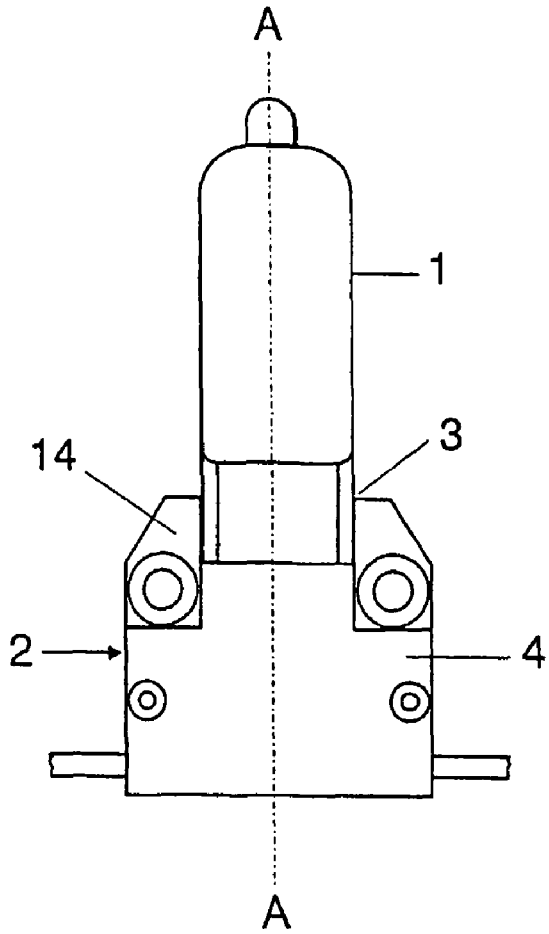

FIG. 10 shows a halogen incandescent lamp 1 having a single base, as is described similarly in EP 652 610 or EP 897 604. In this case, the power supply lines are bent around in a suitable manner at the pinch seal 3 of the lamp bulb. The lampholder 2 is produced from polymer-ceramic. The material of the lampholder is in particular a composite material. In this case, the composite material may be inorganic, organic or a mixture of organic and inorganic components. FIG. 10 illustrates an embodiment in which the lampholder comprises two parts 4 and 14, which consists of different materials from the abovementioned classes. It is naturally also possible for an integral lampholder consisting of a material from the abovementioned classes to be used. Feed lines protrude laterally from the lampholder.

The production of the lampholder takes place in a similar manner to as described further above for the production of the base. Such a lampholder can naturally also be used together with a conventional or novel base as described above.

The production of the lampholder takes place in a similar manner and analogously to as described in conjunction with the production of a base, in particular by the a) provision of feed lines;

b) injection-molding of the precursor of the polymer-ceramic material around the contact pins.

The various base types described here and the various production methods described in this regard can also be used in analogous form for lampholders.

The invention claimed is:

1. A lamp comprising:

a light source;

an enveloping part sealing said light source, the enveloping part having an end;

at least one power supply line being passed from the light source through the end of the enveloping part, and;

at least one contact pin, a base for providing an electric connection to said power supply line;

wherein the base is fixed to said end of the enveloping part by directly molding the base thereon and the base consists of polymer-ceramic and wherein the at least one contact pin is manufactured from the same or a similar material to the base.

2. The lamp as claimed in claim 1, wherein at least one contact pin contour is integrally formed on the base.

3. The lamp as claimed in claim 2, wherein the contact pin contour has a metallic coating.

4. The lamp as claimed in claim 2, wherein the contact pin contour consists of an electrically conductive polymer-ceramic.

5. The lamp as claimed in claim 1, wherein at least one fuse is inserted in the base, preferably by the material of the polymer-ceramic being injection-molded around the fuse.

6. The lamp as claimed in claim 1, wherein at least one fuse section is integrally formed on the base.

7. The lamp as claimed in claim 6, wherein the fuse section has a metallic coating or consists of conductive polymer-ceramic.

8. The lamp as claimed in claim 6, wherein the fuse section is connected to a contact pin via a fuse wire.

9. The lamp as claimed in claim 1, wherein the base is fixed directly to the enveloping part, preferably by it being injection-molded to the end of the enveloping part.

10. The lamp as claimed in claim 1, wherein the enveloping part is an outer envelope or the only bulb or a reflector part.

11. The lamp as claimed in claim 1, wherein the polymer ceramic material of the base is a composite material, which is inorganic, organic or a mixture thereof.

12. The lamp as claimed in claim 1, wherein there are two power supply lines being passed from the light source through the end of the enveloping part.

13. The lamp as claimed in claim 1, wherein the at least one metallic contact pin is fixed to the base by the polymer-ceramic adhering to the contact pin by means of injection molding.

* * * * *